US005670848A

United States Patent [19]

Lidström

[11] Patent Number: 5,670,848

[45] Date of Patent: Sep. 23, 1997

[54] LIGHT MONITORING SYSTEM

[75] Inventor: Kjell Lidström, Bureå, Sweden

[73] Assignee: K Lidstrom AB, Skelleftea, Sweden

[21] Appl. No.: 562,377

[22] Filed: Nov. 24, 1995

[30] Foreign Application Priority Data

Oct. 11, 1995 [SE] Sweden ..... 9503531

[51] Int. Cl.[6] ..... H05B 41/16

[52] U.S. Cl. ..... 315/282; 315/283; 315/279; 315/290; 323/305; 323/306; 340/641

[58] Field of Search ..... 315/282, 283, 315/290, 279, 276, 210, 212, 219, 223; 323/301, 302, 305, 306; 340/641

[56] References Cited

U.S. PATENT DOCUMENTS 3,652,923 3/1972 Knudson ..... 323/6
4,185,232 1/1980 Ingalls et al. ..... 315/241 R
4,939,505 7/1990 Cappellini et al. ..... 340/642
5,289,110 2/1994 Slevinsky ..... 315/279 X

*Primary Examiner*—Robert Pascal
*Assistant Examiner*—Haissa Philogene
*Attorney, Agent, or Firm*—Law Offices Pollock, Vande Sande & Priddy

[57] ABSTRACT

A series-fed light monitoring system, used for example for runway lights at airports, and fed by a low-frequency feeding current, comprises at least one series loop having one or more loading points connected in series in the form of fittings with lamps or the like, each loading point being connected to the loop via transformer coupling comprising in series a high-frequency transformer, a switch and a choke. The switch and the choke are connected in series in the series loop and the high-frequency transformer is connected on the primary side to the series loop and on the secondary side to the loading point. The choke has an inductance so as not to hinder a low-frequency feeding current in the loop but provide high impedance at the switching frequency.

15 Claims, 2 Drawing Sheets

LIGHT MONITORING SYSTEM

FIELD OF THE INVENTION

The present invention relates to a series-fed light monitoring system, for example runway lights at airports, comprising at least one series loop with one or more loading points connected in series in the form of fittings with lamps or the like, each loading point being connected via a transformer coupling.

BACKGROUND OF THE INVENTION

Most airports around the world have runway light systems with so-called series feed. These systems comprise of a number of long loops around taxiways and landing runways, each with a number of fittings with lamps connected in series. The loops are fed by constant-current generators.

According to an international standard, at full lighting power, 6.6 amperes 50 or 60 Hz alternating current flows in each loop. For a long loop, the feed voltage can then amount to 5000–6000 volts. The series-loop is usually fed by a thyristor device or the like from a low-voltage network. Situated between the thyristor and the loop is a transformer which increases the voltage.

In order that the loop not be broken, with all lamps going out when one lamp breaks down, each lamp is fed via a current transformer. If the load on the secondary side, i.e. the lamp, fails away, the transformer reaches saturation with the result that only a limited voltage drop occurs across the primary side of the transformer.

The current transformer, which also has an important personal safety function on lamp exchange, is heavy and awkward. It has to handle a voltage test of 10 kV between the primary and secondary side resulting in great demands on the insulation which makes it difficult to manufacture. The transformer must, moreover, have a good connection between the windings which often leads to corona discharges which drastically reduces its life.

By superposing a relatively high-frequency signal on the current through the loops, the lighting can be checked and controlled at points along the loop.

A receiver and a transmitter are connected between each lamp and associated current transformer. A control system connected to the feeding point of the loop can thus turn on and turn off each lamp individually, and also obtain information on any lamps which are out of order.

One of the problems with communication along the loop is that the inductance of the cable and the inductances of the current transformers produce a high series impedance which greatly attenuates the signals.

SUMMARY OF THE INVENTION

The aim of the present invention is to produce a light monitoring system according to the first paragraph above which solves the problems of attenuation of the signalling, replaces the awkward current transformer and, moreover, offers a simple arrangement for turning the lamps on and off individually, and in order, to transmit responses back to the feed point of the loop. Also in certain configurations, it is possible to individually and steplessly adjust the light from the lamps.

The aim of the invention is achieved by a light monitoring system in which the transformer coupling comprises a high-frequency transformer, a switch and a choke. The switch and choke are connected in series in the series loop, and the high-frequency transformer is connected on the primary side to the series loop and on the secondary side to the loading point. Also, the choke is dimensioned so as not to hinder the low-frequency current in the loop but to have high impedance at the switching frequency.

By means of the invention, the expensive and bulky low-frequency current transformers can be replaced by small high-frequency transformers. Signalling and power feeding are separated by capacitive and inductive components which also compensates for the series inductance in the cable loop.

A high-frequency switch in each fitting can, in addition to turning the lamp on by chopping the low-frequency power to high-frequency, also be used the signal back to the feeding point of the loop. According to an advantageous embodiment of the light monitoring system, the switch is, in this case, arranged to work in a first, higher frequency range for normal feeding of the high-frequency transformer and a second, lower frequency range for signalling. Advantageously, the switch can be arranged to work in the lower frequency range at two different frequencies corresponding to a first and second binary state respectively. By these means, binary coded information can be transmitted from a loading point to the feeding point of the loop.

According to another advantageous embodiment, the switch can be controlled so that the ratio between the time the switch is closed, and the sum of the time the switch is closed and opened, can be varied. By controlling the duty cycle of the switch, stepless adjustment of the current to the lamp results.

To prevent the feeding frequency from reaching the primary side of the high-frequency, the primary side of the high-frequency transformer is advantageously connected across the switch via a capacitor.

In a further advantageous embodiment, the transformer coupling comprises a capacitor connected in parallel with the series connection of the switch and the choke. The capacitor has low impedance at the switch frequency but relatively high impedance at the signalling frequencies. By means of the capacitor, high-frequency ripple current from power transformation is prevented from appearing on the series loop. The capacitor can also serve to compensate for the inductance in the loop.

According to another advantageous embodiment, a resonance circuit is included in the transformer coupling. By introducing this resonance circuit, an almost sinusoidal lamp current is obtained. As a result interference radiating from the lamp of the loading point is drastically reduced. The inductance of the resonance circuit can be constituted wholly or partly by the leakage inductance of the high-frequency transformer. The resonance circuit can be constituted by a series resonance circuit or a parallel resonance circuit.

Alternatively, in order to reduce the interference, the secondary side of the high-frequency transformer can, according to yet another embodiment, be connected to the loading point via a frequency-reducing switch network. By these means, the low-frequency current which is fed into the loop is reproduced. Advantageously, the switch network includes a synchronously rectifying stage and an inverting stage.

In a simple embodiment, the primary winding and choke of the high-frequency transformer are constituted by a common component. The switch can for example be constituted by two HEX-FET transistors.

The invention will be described below in greater detail with reference to the attached drawings, in which:

DETAILED DESCRIPTION OF THE PREFERRED EMBODIMENT

Figure 1:
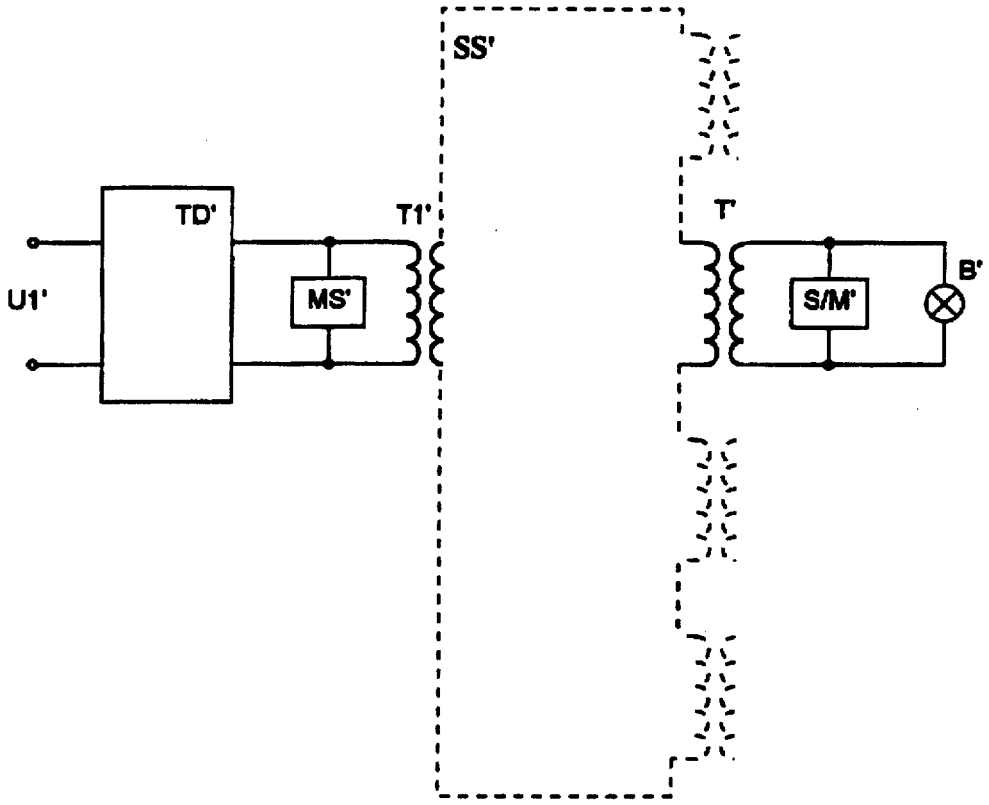
PRIOR ART Figure 1
FIG. 1 shows an example of a known light monitoring system installed at an airport.

The known light monitoring system shown in FIG. 1 shows a series loop SS', to which a number of loading points B' in the form of lamps are connected via a transformer coupling in the form of a current transformer T' associated with to each loading point. The loop is fed from a constant current generator in the form of a thyristor device TD' fed from a low-voltage network U1' and connected to the series loop SS' via a voltage-increasing transformer T1'. A transmitter and receiver S/M' is connected between each loading point B' and the associated current transformer T'. A control system MS' connected to the feeding point of the loop is in contacts with each individual loading point B' and can turn the lamps connected at the respective loading points on and off, and also obtain information on any inoperative lamps.

Figure 2:
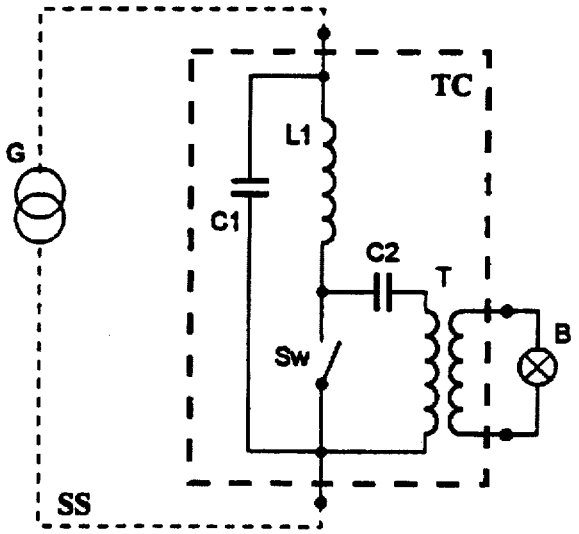
FIG. 2 shows a first embodiment of a light monitoring system according to the invention.

FIG. 2 shows a first embodiment of a light monitoring system according to the invention, in which a constant current generator G, which can be of the type described with reference to FIG. 1, is connected to a series loop SS. Along the loop, a number of loading points B in the form of lamps are connected in series via a transformer coupling TC belonging to each loading point, only one of which is shown.

According to the transformer coupling TC shown in FIG. 2, a rapid-action switch Sw, which in the closed state can conduct current in both directions, is arranged in series with a choke L1 which is dimensioned in such a manner that it does not constitute a hindrance to the feed current at 50 or 60 Hz in the loop but has high impedance at normal switch frequency. Arranged in parallel with these two components is a capacitor C1 which has low impedance at the switching frequency but relatively high impedance at frequencies used for signalling between loading point and feeding point for the series loop. The switch Sw can, for example comprise series-connected, oppositely directed, HEX-FET transistors or the like.

Across the switch Sw, a high-frequency transformer T is connected via a capacitor C2 which blocks the 50 or 60 Hz component existing in the voltage across the switch Sw. The loading point B in the form of a lamp is connected to the secondary side of the high-frequency transformer T. The current in the series loop SS is conducted through the choke L1 in the coupling and, when the switch is pulsed with high frequency, alternately through the switch and the primary winding of the transformer T. When the switch Sw is closed, current flows both from the loop and from the transformer through the switch. Capacitor Cl short-circuits the high-frequency ripple current which is formed in the choke L1 so that it does not appear on the loop.

For signalling, the switch is opened and closed at different frequencies which are considerably lower than the normal switch frequency, and is thus not short-circuited by the capacitor Cl but can be sensed with a receiver (not shown) at the feeding point of the loop. For example, binary signalling can be used with '1'=4 kHz and '0'=6 kHz. Each bit is transmitted for example for a half period of the network frequency, i.e. 10 ms at 50 Hz. Those switches which for the time being are not being used as signal transmitters can, for example, operate at 40 kHz.

If the switch is closed 50% of the time, the current in the transformer T will be the same as the current in the loop, and if the switch is closed the whole time, the current in the transformer is of course zero. A stepless adjustment can be carried out between these two extremes. With appropriate dimensioning of the choke L1, the possibility moreover exists of, by allowing the switch Sw to be closed less than 50% of the time, thereby increasing the current in the transformer T so that it becomes greater than the current in the loop. In this manner, individual lamps along the loop can be made to shine more strongly than the level set for the time being in the loop with the current.

The simple coupling in FIG. 2 has the advantage of very small losses. However, for certain applications, the lamp can radiate interference of an unacceptable level. By introducing a resonance circuit, however, an almost sinusoidal lamp current is obtained. By these means, the interference is reduced drastically. Two methods can be applied, series and parallel resonance respectively, shown in FIGS. 3 and 4 respectively.

Figure 3:
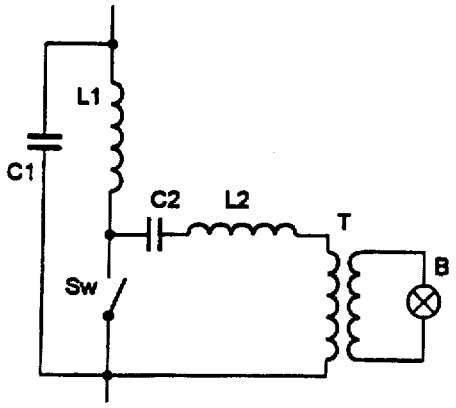
FIG. 3 shows a second embodiment of a light monitoring system according to the invention with a series resonance circuit.

FIG. 3 shows the series resonance case. In this case, the coupling capacitor C2 is included between the switch Sw and the transformer T in the resonance circuit. The inductance in the resonance circuit consists of the leakage inductance of the transformer, possibly in series with an external inductance L2. The capacitor C1 is dimensioned in such a manner that the series inductance in the loop is compensated.

Figure 4:
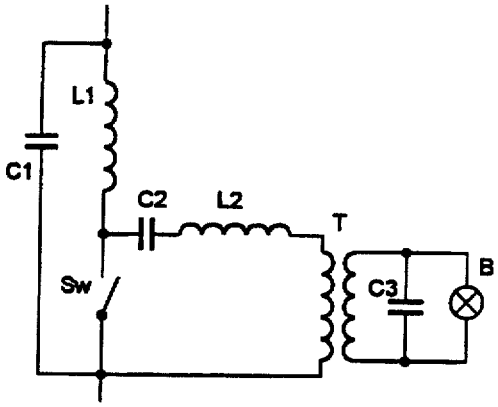
FIG. 4 shows a third embodiment of a light monitoring system according to the invention with a parallel resonance circuit.

In FIG. 4, a parallel resonance case is shown. A capacitor C3 is situated, in this case, on the secondary side of the transformer, parallel with the secondary winding of the transformer to form a parallel resonance circuit. In this case, the capacitor C2 has only the task of blocking the network frequency and therefore has considerably higher capacitance. Like the series resonance case, the inductance in the resonance circuit consists of the leakage inductance of the transformer, possibly in series with an external inductance L2. The capacitor Cl is dimensioned in such a manner that the series inductance in the loop is compensated.

Figure 5A:
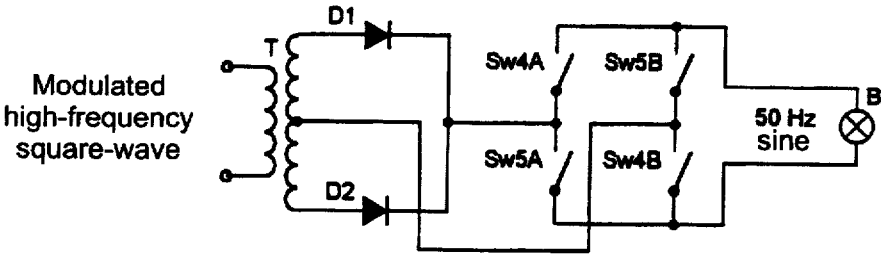
FIGS. 5A and 5B show examples of a frequency-reducing switch network which can form part of the light monitoring system according to the invention.

FIG. 5A shows a rectifier coupling D1, D2 with a following switch network Sw4A, Sw4B, Sw5A, Sw5B to be connected between the secondary side of the high-frequency transformer T and the loading point B in the form of a lamp. The switch network reduces interference from the loading point while concurrently, the option of stepless adjustment of individual lamps can be retained. The idea of the switch network is to reproduce the net frequency, 50 or 60 Hz, in the current feeding the filament of the lamp. However, it is not suitable to feed the lamps with direct current due to the risk of galvanic corrosion.

Figure 5B:
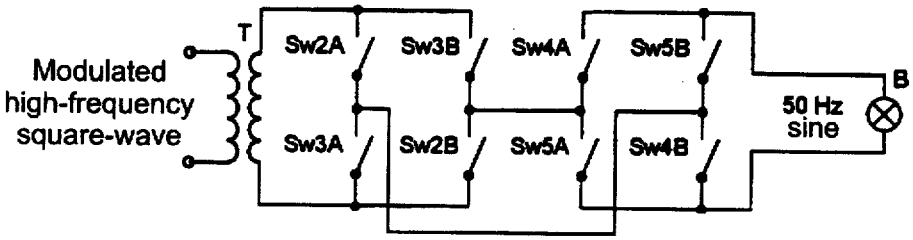

FIG. 5B shows a variant with "synchronous rectification". A synchronous rectifier has considerably lower losses than a passive rectifier and is therefore preferable when efficiency is significant. At the frequencies which are used in this application, however, great demands are made on switch elements.

The switches Sw4A, Sw4B, SwSA, Sw5B and Sw2A, Sw2B, Sw3A, Sw3B, Sw4A, Sw4B, Sw5A, Sw5B respectively in the switch network in FIGS. 5A and 5B are constituted by rapid-action, semi-conductor switches. They are controlled in pairs so that the switches A and B with the same number are closed simultaneously. The switches 2 are closed when the switches 3 are open and vice versa. The same applies for the pairs 4 and 5. The switch pairs 2 and 3 in FIG. 5B moreover work synchronously with the switch Sw in FIG. 1 and thus bring about synchronous rectification. The switch pairs 4 and 5 in FIGS. 5A and 5B constitute an inverter which reproduces the network frequency which below is assumed to be 50 Hz. The last-mentioned switch pair 4 and 5 is switched synchronously with the original 50 Hz current and since the high frequency, which is itself constituted by a "square wave", is constantly modulated with a 50 Hz sine wave, thereby obtaining a sinusoidal 50 Hz current again.

A variant of the above couplings is to combine the choke L1 with the primary winding of the high-frequency transformer T in a single component.

Figure 6:
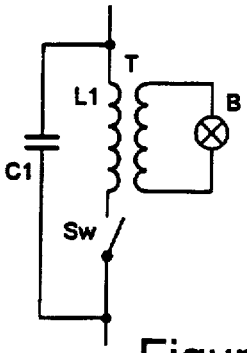
FIG. 6 shows a fourth embodiment of a light monitoring system according to the invention.
Figure 7:
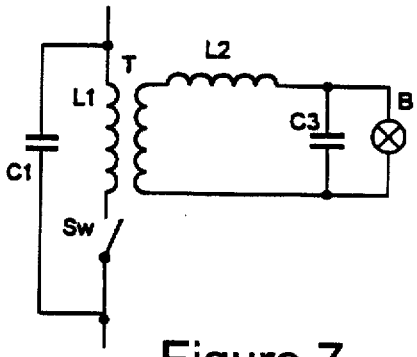
FIG. 7 shows a fifth embodiment of a light monitoring system according to the invention with a parallel resonance circuit.

FIG. 6 shows a simple case as compared with FIG. 2. FIG. 7 shows the parallel resonant case. In the last two cases also, the inductance L2 can be constituted by the leakage inductance of the transformer. It can be seen that the capacitor C2 has been omitted. In this connection, it can also be pointed out that the reproduction of 50 Hz described above with reference to FIG. 5 can be applied in the same manner in the coupling according to FIG. 6 as in a coupling according to FIG. 1.

The invention is not limited to the exemplary embodiment described above but can be subjected to modifications within the scope of the following patent claims and the inventive idea.

I claim:

1. A series-fed light monitoring system, used for example for runway lights at airports, and fed by a low-frequency feeding current, said system comprising at least one series loop having one or more loading points connected in series in the form of fittings with lamps or the like, each loading point being connected to said loop via transformer coupling comprising in series a high-frequency transformer, a switch and a choke, the switch and the choke being connected in series in the series loop and the high-frequency transformer being connected on the primary side to the series loop and on the secondary side to the loading point, said choke having an inductance so as not to hinder a low-frequency feeding current in the loop but providing high impedance at the switching frequency.

2. A light monitoring system according to claim 1 wherein the primary side of the high-frequency transformer is connected to the switch via a capacitor for blocking the low-frequency feeding current.

3. A light monitoring system according to claim 1 wherein the transformer coupling comprises a capacitor connected in parallel with the series coupling of said switch and said choke.

4. A light monitoring system according to claim 3 wherein said capacitor has capacitance to compensate the series inductance in the loop.

5. A light monitoring system according to claim 1 further comprising a resonance circuit included in the transformer coupling.

6. A light monitoring system according to claim 5 wherein an inductance of the resonance circuit is constituted at least in part by the leakage inductance of the high-frequency transformer.

7. A light monitoring system according to claim 5 wherein said resonance circuit is constituted by a series resonance circuit.

8. A light monitoring system according to claim 5 wherein said resonance circuit is constituted by a parallel resonance circuit.

9. A light monitoring system according to claim 5 wherein said secondary side of the high-frequency transformer is connected to the loading point via frequency-reducing switch network.

10. A light monitoring system according to claim 9 wherein said switch network comprises a synchronously rectifying stage and an inverting stage.

11. A light monitoring system according to claim 9 wherein said primary winding of the high-frequency transformer and said choke constitute a common component.

12. A light monitoring system according to claim 5 wherein said switch works in a first, higher frequency range for normal feeding of the high-frequency transformer and in a second, lower frequency range for signalling.

13. A light monitoring system according to claim 12 wherein said switch works in the lower frequency range at two different frequencies corresponding to a first and a second binary state respectively.

14. A light monitoring system according to claim 5 wherein said switch is controllable to vary the ratio between the time the switch is closed and the sum of the time the switch is closed and, opened.

15. A light monitoring system according to claim 5 wherein said switch is constituted by two opposite connected HEX-FET transistors.

* * * * *